US006032495A

United States Patent [19]

Leu

[11] Patent Number: 6,032,495

[45] Date of Patent: Mar. 7, 2000

[54] WASH BALL

[76] Inventor: Shiow Jiuan Freida Leu, No. 487, Noan Noan St., Noan Noan District, Keelung City, Taiwan

[21] Appl. No.: 09/260,560

[22] Filed: Mar. 2, 1999

[51] Int. Cl.[7] ..... D06F 39/02

[52] U.S. Cl. ..... 68/17 R; 510/439; 205/0.5

[58] Field of Search ..... 68/17 R, 207; 134/93; 510/439; 205/0.5

[56] References Cited

U.S. PATENT DOCUMENTS

| | | |
|---|---|---|
| 395,515 | 1/1889 | Robertson . |
| 1,473,430 | 11/1923 | Hirschhorn et al. . |
| 1,497,199 | 6/1924 | Sutthoff . |
| 2,258,030 | 10/1941 | Oxley . |
| 3,643,834 | 2/1972 | Sabation . |
| 4,345,512 | 8/1982 | Moore . |
| 4,374,571 | 2/1983 | Hirvela . |
| 4,532,722 | 8/1985 | Sax . |
| 4,545,917 | 10/1985 | Smith et al. . |
| 4,549,693 | 10/1985 | Barlics . |
| 4,567,675 | 2/1986 | Rennie . |
| 5,433,882 | 7/1995 | Matsumoto . |
| 5,768,917 | 6/1998 | Freida . |
| 5,924,151 | 7/1999 | Connan . |
| 5,946,951 | 9/1999 | Watanabe . |

FOREIGN PATENT DOCUMENTS 329539 10/1998 France ..... 68/17 R

OTHER PUBLICATIONS

European Patent Application (EPO) 329,538 68/17R, Aug. 1989.

*Primary Examiner*—Frankie L. Stinson
*Attorney, Agent, or Firm*—Bacon & Thomas, PLLC

[57] ABSTRACT

A wash ball comprises an upper and an lower case half both of which have a semi-spherical shell body with openings formed thereon. The connecting end of the upper case half is provided on the end surface with a plurality of cavities and on the peripheral surface with outer screw threads. The lower case half is also provided with openings on the shell body and a plurality of embossed round dots on the end surface and an annular flange around the connecting end. The annular flange has internal screw threads formed on the inner wall surface. With such an arrangement, the upper and the lower case half can be put together to enclose solid detergent therein by means of the engagement of screw threads. When the upper case half links with the lower case half to form a wash ball, each embossed round dot extends into a cavity to prevent the ball from loosened in water. The wash ball has the advantages of simplified structure and assembling processes.

2 Claims, 3 Drawing Sheets

WASH BALL

BACKGROUND OF THE INVENTION (a) Field of the Invention

The present invention relates to a wash ball structure, especially to an improved wash ball structure that receives high molecular active solid detergent. The wash ball comprises two semi-spherical case halves that are joined by means of screw threads so that the solid detergent in the wash ball can be replenished when it is used up. The wash ball structure according to the invention can provide convenience in assemblage and the advantage of environment protection.

(b) Description of the Prior Art

People usually wash clothes by using powdered detergent, concentrated liquid detergent, and gel detergent. To achieve the object of cleaning clothes thoroughly, they often pour a large quantity of detergent into a washing machine so that the machine can automatically clean clothes. Then the washing machine drains waste water to outdoor ditches. Home used wastewater generally contains chemicals like fluorescer, phosphorus and so on. A large amount of wastewater flowing into rivers and ocean has tremendously polluted our ecological environment. In view of the fact, the applicant of this invention has worked out new ball type high molecular active solid detergent, which is especially suitable for washing clothes in a washing machine. To make the ball type solid detergent fit for use in a washing machine and able to be used repeatedly, it is necessary to make use of a container that can receive the ball type solid detergent and hold it therein. The detergent held in such a container must be able to dissolve when the container is immersed in water. Hence the inventor provides a wash ball structure that can keep the ball type detergent therein. When the wash ball is put into water, the detergent, through openings formed on the surface of the wash ball, makes dirt disintegrated.

SUMMARY OF THE INVENTION

The primary object of the invention is to provide a wash ball structure comprising an upper case half and an lower case half. The lower case half has an annular flange around the connecting end. The annular flange is provided with screw threads on the inner wall surface thereof. The upper case half also has screw threads formed on the periphery of the connecting end. Thus the upper and the lower case halves can be joined with each other to form a hollow spherical shell body that can receives ball type high molecular active solid detergent to become a simple and innovative wash ball. When the granular solid detergent is used up, users can open the wash ball and re-fill solid detergent. Hence, the wash ball according to the invention can provide the advantage of saving money. In addition, the design of annular flanges provides protection for joints between the case halves. When the wash ball floats in a washing machine, water flow won't directly hit the joints. Therefore, the wash ball can be repeatedly used for a long time.

The further object of the invention is to provide a wash ball structure of which the upper case half has cavities dispersed on the surface of the connecting end and the lower case half has embossed round dots formed on the surface of the connecting end in positions corresponding to the cavities. The embossed round dots extend into the cavities to enhance the connection between the upper and the lower case halves when the case halves are coupled with each other. Such a design prevents the joined case halves from being loosened due to floating in water.

The another object of the invention is to provide a wash ball structure that includes a floating ball therein. Thus the wash ball immersed in water will not stay on the bottom of the water tank but float in water. This will bring the wash ball to move up and down along with the water flow. As a consequence, the solid detergent can be more efficiently dissolved in the water.

DETAILED DESCRIPTION OF THE PREFERRED EMBODIMENTS

Figure 1:
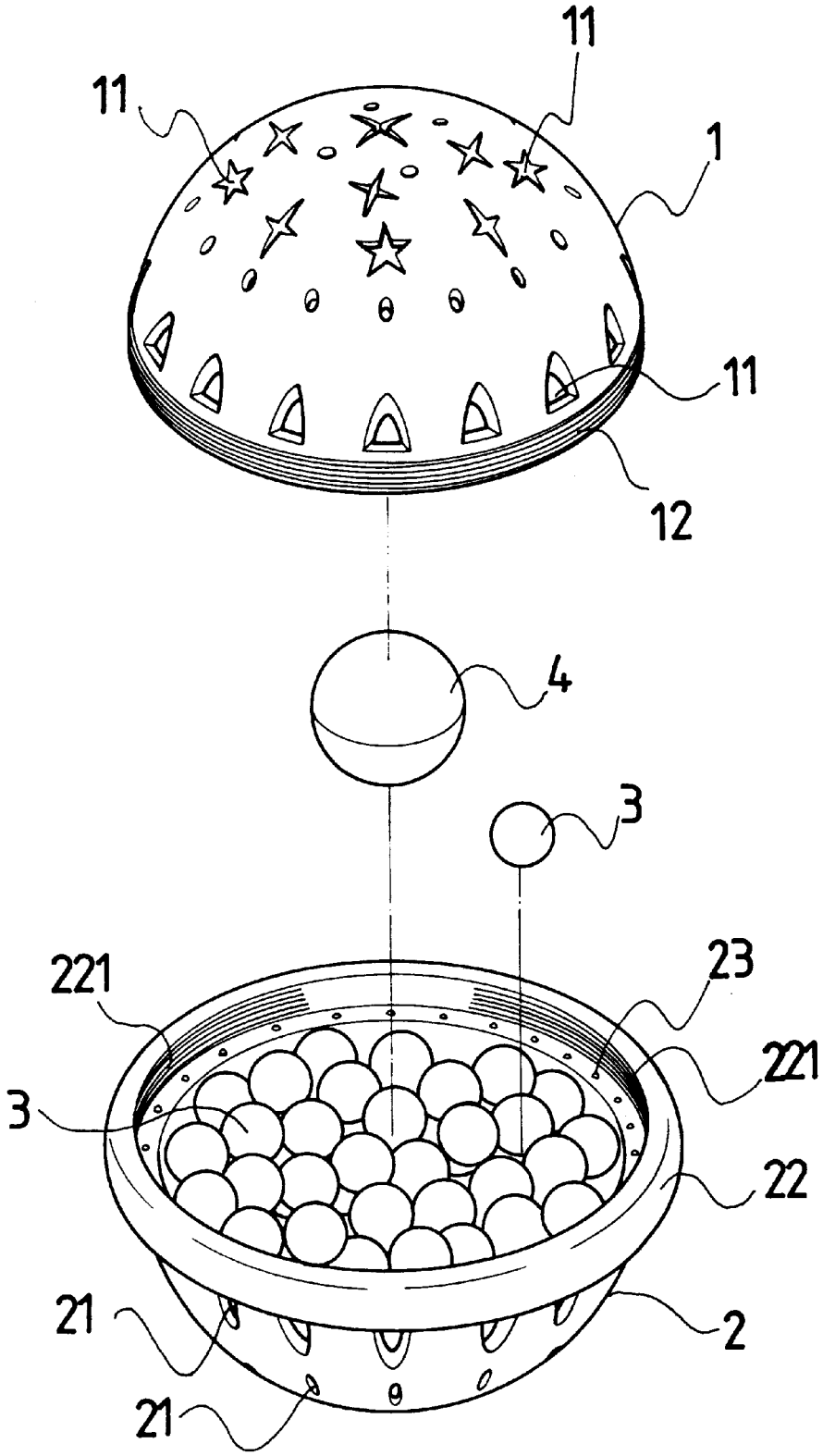
FIG. 1 is an explode view of an embodiment of the wash ball according to the invention.
Figure 2:
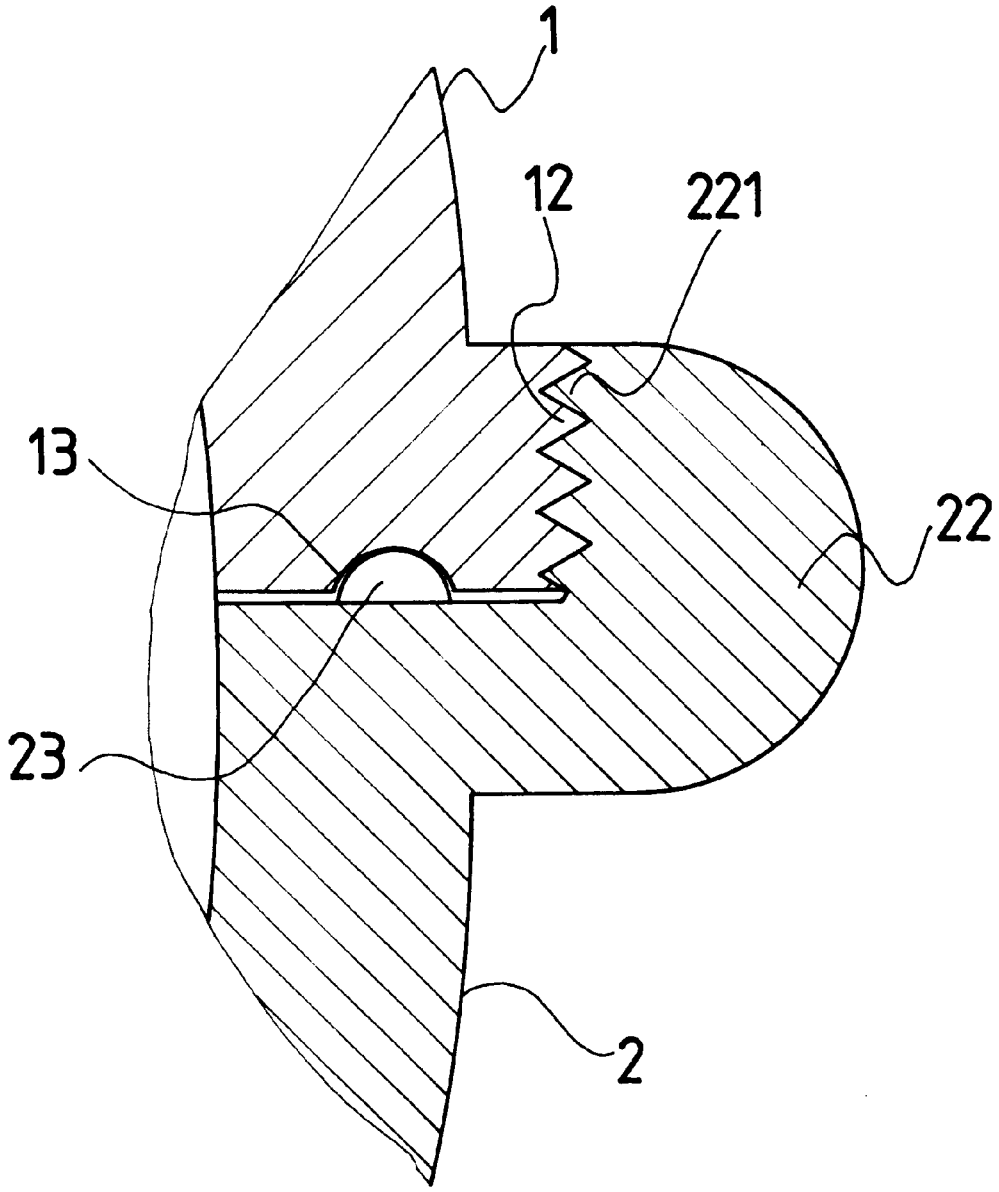
FIG. 2 is a cross sectional view illustrating the engagement between the embossed round dots and the recessed cavities.
Figure 3:
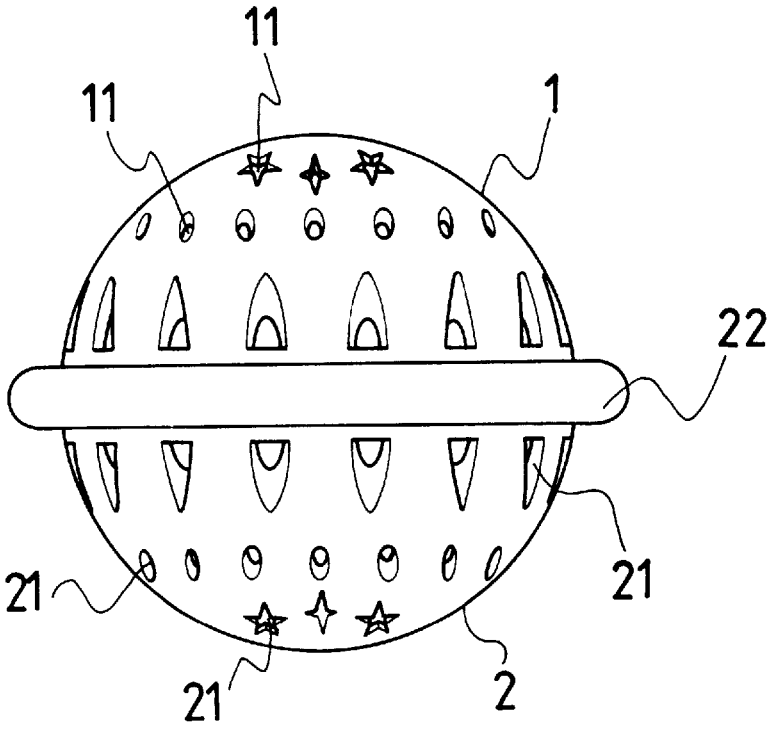
FIG. 3 is a plan view schematically showing the outer appearance of the wash ball according to the invention.

As shown in FIGS. 1 and 2, the wash ball of the invention comprises an upper case half 1 and a lower case half 2.

The upper case half 1 is a hollow semi-spherical shell body with a plurality of holes on the semi-spherical shell surface. These holes can be of various shapes, such as star shapes, cross shapes, or circular shapes. The upper case half 1 further has external screw threads 12 around the connecting end and a plurality cavities 13 scattered on the end surface of the connecting end.

Like the upper case half 1, the lower case half 2 is also a hollow semi-spherical shell with a plurality of holes 21 on the semi-spherical surface. However, it has an annular flange 22 around the connecting end. The flange 22 is larger than the semi-spherical shell in diameter. The flange 22 has internal screw threads 221 formed on the inner wall surface and a plurality of embossed round dots 23 dispersed on the connecting end surface.

Figure 4:
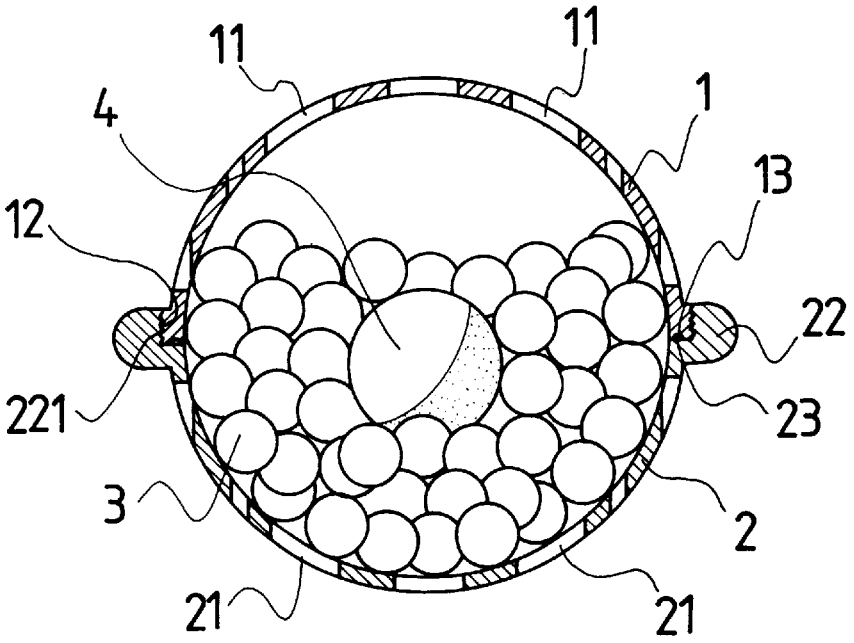
FIG. 4 is a cross sectional view schematically showing a wash ball assembly.

With the configuration of the upper and the lower case halves 1 and 2, users can put ball type high molecular active solid detergent 3 into an upper or a lower case half 1 or 2 and then screw the upper and the lower case halves together by means of the screw thread engagement to keep the solid detergent therein as shown in FIG. 4. Coupling the upper case half 1 with the lower case half 2 makes embossed round dots 23 extend into cavities 13, which enhances the combination between the upper and the lower case half. Thus the wash ball structure according to the invention has the advantage of preventing looseness. When solid detergent 3 is used up, users can open the wash ball and replenish solid detergent 3. This provides an advantage of repeated use of ball cases. Therefore, the invention can avoid unnecessary wasting and meets the requirement of ecological environment protection as well as cost saving.

The lower case half 2 of the present invention is designed to have an annular flange 22 around the connecting end. The annular flange embraces the periphery of the connecting end of the upper case half 1. The annular flange 22 in cooperation with the engagement between embossed round dots and cavities provides an enhanced combination between the upper and the lower case half. As a result, when the wash ball floats up and down in a washing machine, the solid detergent 3 therein gradually dissolves. The annular flange 22 can protect the joints between the upper and the lower case half 1 and 2 from direct hits by water flows. Thus the wash ball can have an elongated service life and can be used repeatedly, obtaining the purpose of cost savings and ecological environment protection.

In addition, to make the wash ball able to effectively float in water flows, the wash ball can incorporate a floating ball 4 therein as shown in FIGS. 1 and 4. The floating ball 4 is a hollow closed spherical plastic shell. It also can be made of polyfoam or foam sponge, which has a buoyant property. This makes the wash ball float on the water surface and move up and down along with water flows. Experiments show the solid detergent in a floating wash ball has a much better solubility than that in a wash ball staying on the bottom of a washing tank.

What is claimed is:

1. A wash ball structure comprising an upper case half and a lower case half and wherein the upper case half is a hollow semi-spherical shell with a plurality of holes on the surface thereof, has external screw threads around the connecting end and is provided with a plurality of cavities scattered on the end surface of the connecting end; and the lower case half is also a hollow semi-spherical shell with a plurality of holes on the surface and has an annular flange around the connecting end;

said annular flange being larger than the semi-spherical shell in diameter and having internal screw threads formed on the inner wall surface and a plurality embossed round dots dispersed on the connecting end surface;

said upper case half and said lower case half being coupled with each other by means of an engagement between the external and the internal screw threads and an engagement between the embossed round dots and the recessed cavities to form a wash ball that can avoid looseness due to water wash.

2. The wash ball structure as claimed in claim 1, wherein said wash ball consisting of an upper and an lower case half can incorporate a hollow and closed floating ball therein.

* * * * *